United States Patent [19]

Plice

[11] Patent Number: 4,887,693

[45] Date of Patent: Dec. 19, 1989

[54] WIND AND BREATH NOISE PROTECTOR FOR MICROPHONES

[75] Inventor: Gerald W. Plice, Morton Grove, Ill.

[73] Assignee: Shure Brothers, Inc., Evanston, Ill.

[21] Appl. No.: 65,970

[22] Filed: Jun. 24, 1987

[51] Int. Cl.[4] ..... F01N 7/00

[52] U.S. Cl. ..... 181/242; 181/129; 181/158; 381/156; 381/158; 381/183; 381/189

[58] Field of Search ..... 181/129, 158, 242; 381/69, 154, 156, 159, 183, 189, 158

[56] References Cited

U.S. PATENT DOCUMENTS 2,410,806 11/1946 Black, Jr. et al. ..... 381/189 X
2,456,346 12/1948 Veneklasen ..... 181/242 X
2,745,508 5/1956 Vadersen ..... 181/158
3,124,663 3/1964 Beaudry ..... 181/158 X

*Primary Examiner*—B. R. Fuller
*Attorney, Agent, or Firm*—Allegretti & Witcoff, Ltd.

[57] ABSTRACT

A construction for housing a microphone is disclosed. The construction is configured to improve the wind and noise protection for a small diameter microphone by providing a large diameter opening tapering to a smaller microphone aperture. The construction comprises a housing for a microphone transducer, and an adapter mateable with the transducer and housing. The adapter includes a plate having a greater diameter than the microphone aperture, and tapering to the smaller microphone diameter opening. In the preferred embodiments of the construction, a windscreen is included covering the tapered portion of the adapter.

1 Claim, 1 Drawing Sheet

WIND AND BREATH NOISE PROTECTOR FOR MICROPHONES

BACKGROUND OF THE INVENTION

This invention relates to a construction for reducing wind and breath noise in microphones, and more particularly it relates to an assembly for reducing the sensitivity of sall diameter microphones to the interference cause by air passage from wind or breath.

A problem common to all microphones is the existence of substantial noise produced from air passage over the microphone's surface. Noise produced by wind passage over the microphone is commonly referred to as "puff", and noise produced by the passage of a person's breath over the microphone surface is commonly referred to as "pop". In the prior art, numerous methods have been employed to protect against both puff and pop, including the placement of windscreens or porous materials over the surface of the microphone to reduce the interaction between the moving air and the microphone's surface.

Puff and pop problems are more prevalent in small diameter microphones, especially when the microphone transducer is of the condenser type. Primarily, the greater problems for small diameter microphones result from air turbulence causing a higher net instantaneous total pressure on the surface of a small area microphone than on a larger area microphone. That is, on a microphone having a small area for receipt of sound pressure, there may be in any instance a preponderance of elevated pressure cells, or there may be rarified pressure cells, causing unwanted motion in the microphone sound receiving surface and hence unwanted puff or pop signals.

Conventional methods of reducing puff or pop noise in small diameter microphones are effective. However, a need has arisen for a technique of producing noise reduction that is more effective than currently used in small diameter microphone transducers in such application as, for example, a telephone or radio telephone handset. That is, a means is needed that is more effective than adding a windscreen or a foam (or similar) covering to the microphone transducer.

OBJECTS OF THE INVENTION

Accordingly, it is an object of this invention to provide an improved construction for protecting a small diameter microphone against puff or pop.

Another object of this invention is to provide an improved construction for protecting a small diameter microphone against puff or pop when the microphone is used as part of a telephone handset.

A further object of this invention is to provide improved protection against puff or pop noise that is simple and inexpensive to fabricate.

A additional object of this invention is to provide a construction for reducing puff or pop noise in a microphone transducer that may be applied to a variety of different kinds of small diameter transducers.

SUMMARY OF THE INVENTION

These and other objects of the invention are accomplished by providing an improved microphone housing construction for use with a telephone or radio telephone handset. The improved operates by making a small diameter microphone transducer act like a large unit. The construction comprises a housing for the microphone transducer, and an adapter mateable wit the housing and transducer. The adapter provides a large diameter opening that tapers to a smaller microphone cartridge aperture. The taper forms a concave opening in an expansion plate surface of the adapter, with the expansion surface being of a greater diameter than that of the microphone transducer. In the preferred embodiment, a non-woven fiber windscreen is mounted over the concave taper of the plate.

DETAILED DESCRIPTION OF THE PREFERRED EMBODIMENT

Figure 1:
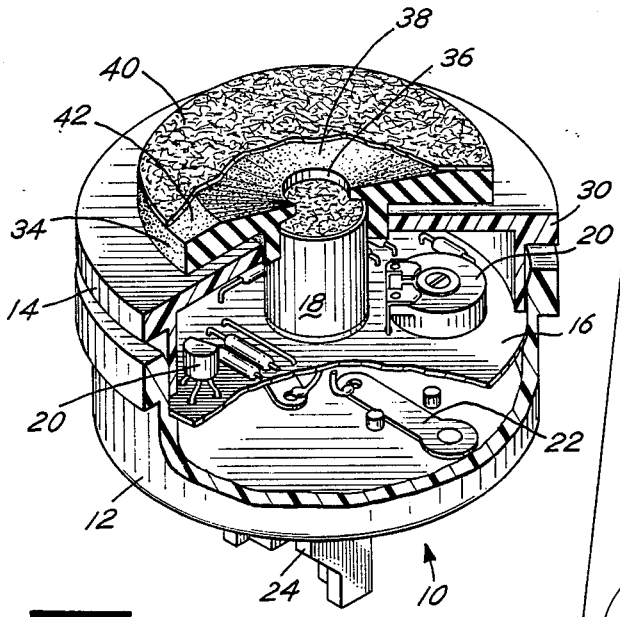
FIG. 1 is a cut-away perspective view of a microphone housing construction incorporating the preferred embodiment of the invention and adapted for use in a radio telephone handset.
Figure 2:
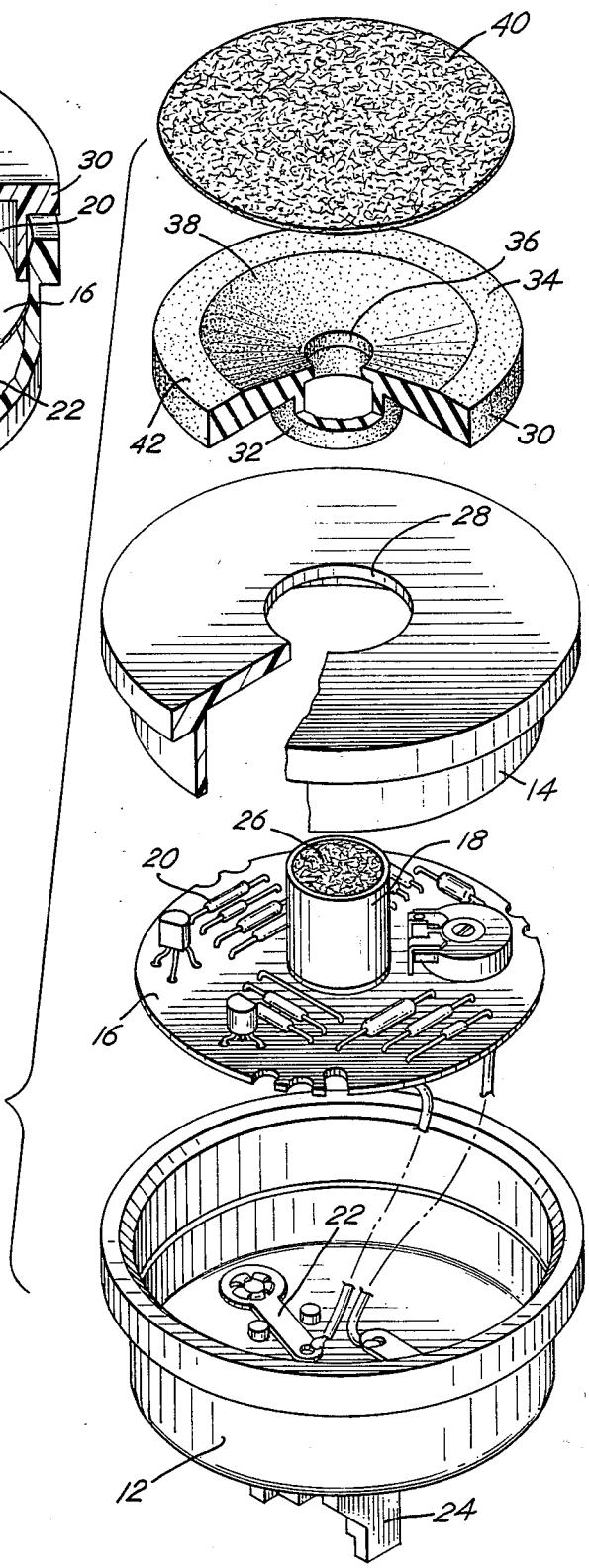
FIG. 2 is an exploded perspective cutaway view of the construction shown in FIG. 1.

Referring now the drawings, the preferred embodiment of the invention is disclosed as a construction 10 for a microphone. The construction 10 of the preferred embodiment is particularly adapted for use in a telephone or radio telephone handset, although the principles used can be applied to any kind of microphone. The construction includes a cup 12 that makes up the basic housing and support for the construction, and a cover 14. The cup and cover are mateable, preferably composed of plastic, and in the preferred embodiment, may be connected by sliding the cover into the cup and maintaining the cover in the cup by a slight friction fit.

The cup 12 provides the support for a circuit board 16, which in turn provides support for a microphone transducer 18. In the preferred embodiment, the transducer is a condenser microphone cartridge. The circuit board contains the necessary electronics 20 to operate the microphone transducer 18. Additionally the cup 12 includes terminals 22 for providing the electrical connection between the electronics 20 (and hence the microphone transducer 18) with the remaining components of the telephone, radio or radio telephone of which the construction is a part. Finally, the preferred embodiment of the cup includes mounting prongs 24 to latch the construction 10 into a handset.

The invention operates by defining a large diameter sound opening that leads to a small diameter sound receiving area or aperture 26 on the microphone transducer 18. In the preferred embodiment, the cover 14 thus has an opening 28 to allow sound to pass to the aperture 26 of the transducer 18. An adapter 30 is mounted on both the cover 14 (by insertion in the opening 28) and the transducer 18. In the preferred embodiment, the adapter 30 includes a receptacle 32 configured to conform to the outside diameter and shape to the transducer 18 and fit within the opening 28.

The preferred embodiment of the adapter 30 is a generally plate-like disk 34 having an opening 36 to allow sound to reach the transducer aperture 26. The disk 34 has a tapered portion 38 that acts to lead sound from the larger area of the disk 34 to the smaller area of the aperture 26. In the preferred embodiment, the disk opening 36 is slightly smaller than the area of the aperture 26 to minimize the direct air pressure on the aperture 26, and to provide a good seating of the adapter 30 against and around the transducer 18.

The preferred embodiment of the construction 10 also includes a wind or filter screen 40 mounted over the tapered portion 38 of the adapter 30. In the preferred embodiment, the windscreen is composed of a non-woven fabric. However, any material suitable for passing sound but reducing incremental pressure differences on the aperture 26 may be used. The preferred embodiment of the adapter includes a flat portion 42 upon which the windscreen 40 may be mounted. In the preferred embodiment, the adapter is composed of a flexible material such as rubber. Flexible materials provide shock absorbtion, and minimize sound transmission through the cup and cover to the transducer.

While the preferred embodiment of the present invention has been set forth in the above detailed description, it is to be understood that the preferred embodiment is only one example of the invention. Other modifications may be used without departing from the scope of the present invention. The invention is only limited by the following claims, including equivalents where appropriate.

What is claimed is:

1. A radio or telephone handset microphone housing construction for reducing wind and breath generated air passage noise, the construction comprising, in combination:

a cup defining a first circular inner surface and a second inner surface, the second inner surface forming a lip contiguous with the first inner surface and having terminals for providing electrical connections;

a circuit board comprising a microphone having a circular sound transducer aperture, the circuit board removably resting on the lip and electrically connected to the terminals;

a removable cover defining a flat outer surface and a cylindrical sleeve extending perpendicularly outward from the flat outer surface, the flat outer surface having a circular opening to allow passage of the transducer aperture, the cover being mateable with the cup by sliding the cylindrical sleeve into the first inner surface of the cup, whereby the cover and cup are frictionally connected and the transducer aperture is generally flush with the flat outer surface;

an adapter comprising flexible material, loosely mounted and mateable with both the transducer aperture and flat outer surface, the adaptor further comprising an expansion plate having a greater diameter than the transducer aperture, the plate defining a sound transmission passage having an opening of smaller diameter than the transducer aperture and having a receptacle configured to conform and frictionally connected to the transducer aperture, the plate further having a flat portion and a sound receiving side away from the transducer aperture configured with a concave taper from the vicinity of the plate's rim to the sound transmission passage; and a circular filter screen comprising non-woven fabric loosely mounted and conforming to the diameter of the plate and mounted on the flat portion of the plate over the concave taper of the plate to reduce incremental pressure differences on the transducer aperture.

* * * * *